United States Patent [19]

Friedle et al.

[11] Patent Number: 4,838,822

[45] Date of Patent: Jun. 13, 1989

[54] SHIFT LINKAGE FOR MARINE PROPULSION DEVICE

[75] Inventors: Dennis J. Friedle, Lake Villa; Richard P. Kolb, Prairie View; M. Jeremy Lieb, Northbrook, all of Ill.

[73] Assignee: Outboard Marine Corporation, Waukegan, Ill.

[21] Appl. No.: 129,457

[22] Filed: Dec. 7, 1987

[51] Int. Cl.[4] ..... B63H 5/06

[52] U.S. Cl. ..... 440/86; 74/851

[58] Field of Search ..... 440/1, 75, 84, 86; 74/851, 852, 861; 123/198 DC, 335, 630; 192/0.062, 0.084

[56] References Cited

U.S. PATENT DOCUMENTS

| | | | |
|---|---|---|---|
| 4,231,316 | 11/1980 | Bland et al. | 440/86 |
| 4,262,622 | 4/1981 | Dretzka et al. | 440/86 |
| 4,403,970 | 9/1983 | Dretzka et al. | 440/86 |
| 4,432,734 | 2/1984 | Bland et al. | 440/86 |
| 4,525,149 | 6/1985 | Broughton et al. | 440/86 |

*Primary Examiner*—Sherman D. Basinger
*Assistant Examiner*—Stephen P. Avila
*Attorney, Agent, or Firm*—Michael, Best & Friedrich

[57] ABSTRACT

Disclosed herein is a marine propulsion device comprising a transmission supported on the marine propulsion device and including a clutch member movable between a neutral position and a drive position, a shift lever supported on the marine propulsion device by a pivotal mounting and connected to the clutch member to effect movement of the clutch member in response to movement of the shift lever, and cam and follower structure adapted to be connected to a remotely actuated link and connected to the shift lever for displacing the shift lever to effect movement of the clutch member, and for permitting over-travel of the link without displacing the shift lever after shift lever movement effecting movement of the clutch member to the drive position, and for temporarily disabling engine ignition at the time of clutch member movement from the drive position.

16 Claims, 2 Drawing Sheets

SHIFT LINKAGE FOR MARINE PROPULSION DEVICE

BACKGROUND OF THE INVENTION

The invention relates generally to marine propulsion devices including reversing transmissions and to remote operation of such reversing transmissions by a push-pull cable.

Remote actuation of a marine propulsion reversing transmission commonly involves operation of a remote single lever control to displace the inner core of a push-pull cable through a distance which is often in excess of the distance actually required at the marine propulsion device for shifting operation. Such over-stroking places unnecessary heavy loading on the push-pull cable in some circumstances.

In the past, attempts have been made to overcome this problem by interposing a spring in the operating linkage. However, use of such a spring can cause delay in shift timing, insufficient load to guarantee shifting, excessive loading after shifting, or over-shooting neutral if the a neutral detent is not strong enough.

Prior ignition interruption mechanisms were actuated when shift loads were greater than a pre-determined amount. Such prior mechanisms were not always as effective as desired.

The arrangements disclosed hereinafter are intended to overcome the foregoing problems.

Attention is direct to the following U.S. Patents: Nos.
3,481,223 D. A. Fraser; Dec. 2, 1969
4,215,596 L. C. Long; Aug. 5, 1980
4,262,622 Dretzka, et al.; Apr. 21, 1981
4,403,970 Dretzka, et al.; Sept. 13, 1983
4,432,734 Bland, et al.; Feb. 21, 1984
4,525,149 Broughton, et al.; June 25, 1985

SUMMARY OF THE INVENTION

The invention provides a marine propulsion device comprising a transmission supported on the marine propulsion device and including a clutch member movable between a neutral position and a drive position, a shift lever supported on the marine propulsion device by a pivotal mounting and connected to the clutch member to effect movement of the clutch member in response to movement of the shift lever, and cam and follower means adapted to be connected to a remotely actuated link and connected to the shift lever for displacing the shift lever to effect movement of the clutch member, and for permitting over-travel of the link without displacing the shift lever after shift lever movement effecting movement of the clutch member to the drive position.

The invention also provides a marine propulsion device comprising a transmission supported on the marine propulsion device and including a clutch member movable between a neutral position and a drive position, a shift lever supported on the marine propulsion device by a pivotal mounting and connected to the clutch member to effect movement of the clutch member in response to movement of the shift lever, and cam and follower means adapted to be connected to a remotely actuated link and connected to the shift lever for displacing the shift lever to effect movement of the clutch member, and for permitting over-travel of the link without displacing the shift lever after shift lever movement effecting movement of the clutch member to the drive position, and for temporarily disabling engine ignition at the time of clutch member movement from the drive position.

The invention also includes a marine propulsion device comprising a transmission supported on said marine propulsion device and including a clutch member movable between a neutral position and two drive positions located respectively on opposite sides of the neutral position, a shift lever pivotally supported on the marine propulsion device and connected to the clutch member to effect movement of the clutch member in response to movement of the shift the lever, which shift lever has thereon a follower, a shift plate pivotally supported on the marine propulsion device and adapted for connection to a remotely actuated link to effect pivotal movement of the shift plate in response to movement of the link, which shift plate has therein a transmission actuating cam slot receiving the follower and including a central portion with a pair of opposite ends, which transmission actuating cam slot is located at a radial distance from the pivotal support of said shift plate, which radial distance increases from one of said cam slot central portion ends to the other of said cam slot central portions ends, said transmission actuating cam slot also including end portions respectively extending from the ends of the central portion at a uniform radius from the pivotal support of the shift plate, a second plate pivotally mounted on the shift plate and having therein an ignition interrupting cam slot receiving the follower, which ignition interrupting cam slot includes a central portion with a pair of opposite ends, and end portions respectively extending from the ends of the central portion, which central portions and which end portions of the transmission actuating cam slot and of the ignition interrupting cam slot are of generally identical size and shape and are located in alignment when the clutch member is in the drive positions, which ignition interrupting cam slot also include first and second opposed side edges, which first side edge has therein a recess adjacent the juncture of the central portion and one of the end portions, and which second side edge has therein a recess adjacent the juncture of the central portion and the other of the end portions, and a switch mounted on one of the shift plate and the second plate and operable, when actuated, to interrupt engine ignition, and an actuator engagable with the switch for actuation thereof to interrupt engine ignition on the other of the shift plate and the second plate.

The invention also provides a linkage adapted for use with a marine propulsion device comprising an engine and a transmission including a clutch member movable between a neutral position and a drive position, which linkage comprises a first member pivotally mounted on a support and movable in coordinated relation to clutch member movement, a second member pivotally mounted on the first member, switch means adapted for interrupting engine ignition, which switch means is mounted on one of the first and second members, an actuator engagable with the switch means for actuation thereof to interrupt engine ignition, which actuator is located on the other of the first and second members and is operable to actuate the switch means to interrupt engine ignition in response to relative displacement between the first and second members, and cam and slot means for actuating the switch means at the time of clutch member movement from the drive position, said cam and slot means including a cam slot on one of the first and second members, and a follower extending from the other of the first and second members into the cam slot for displacing the first and second members relative to each other in response to first member pivotal movement.

Other features and advantages of the invention will become apparent to those skilled in the art upon review of the following detailed description, claims, and drawings.

THE DRAWINGS

Figure 1:
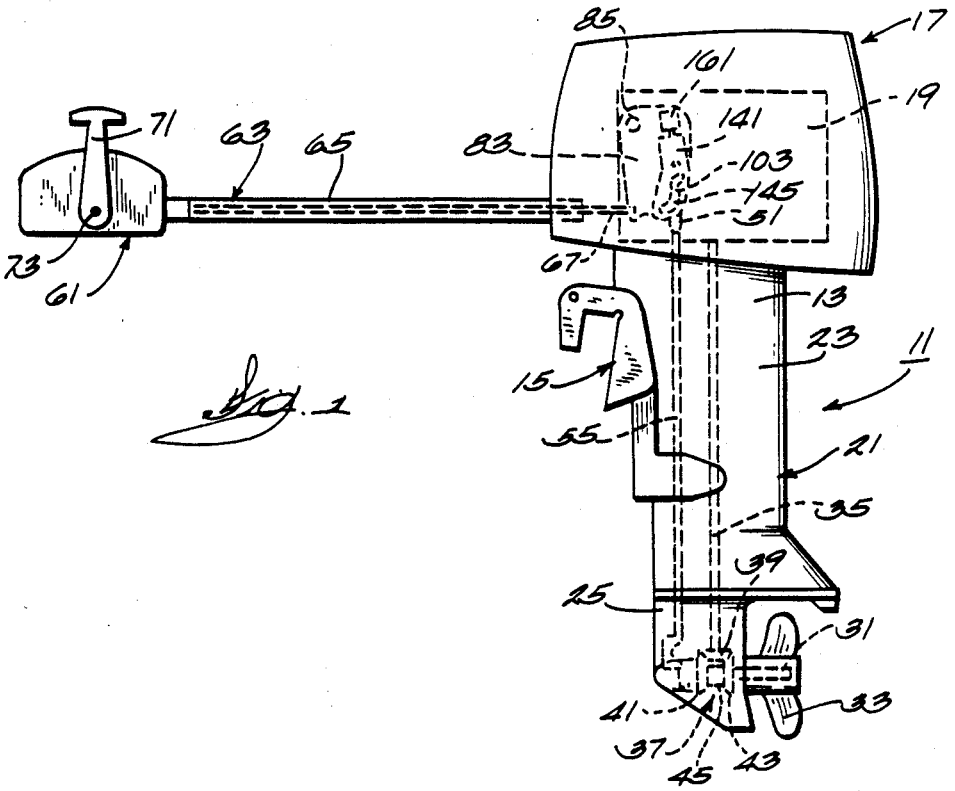
FIG. 1 is a side elevational view of a marine propulsion device embodying various of the features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 is a marine propulsion device 11 which can be either a stern drive unit or an outboard motor and which is in the form of an outboard motor.

The marine propulsion device includes a propulsion unit 13 and means 15 connected to the propulsion unit and adapted for mounting the propulsion unit 13 from the transom (not shown) of a boat for tilting movement in a vertical plane and for steering movement in a horizontal plane. The propulsion unit 13 includes a power head 17 which comprises an internal combustion engine 19 having a crankshaft (not shown) and which is mounted on a lower unit 21 including an upper driveshaft housing 23 and a lower gear case 25.

Extending in the gearcase 25 is a propeller shaft 31 which carries a propeller 33 and which is connected to a driveshaft 35 by a reversing clutch or transmission 37. The driveshaft 35 extends through the driveshaft housing 23 and, at its upper end, is drivingly connected to the engine crankshaft.

The reversing transmission 37 includes a drive pinion 39 fixed to the lower end of the driveshaft 35 and in meshing engagement with a pair of spaced counter rotating bevel gears 41 and 43 mounted in co-axial relation to the propeller shaft 31. A dog or clutch member 45 is splined to the propeller shaft 31 and is shiftable axially of the propeller shaft between a central or neutral position out of driving engagement with the bevel gears 41 and 43, a forward drive position located in axially spaced relation in one direction from the neutral position and in driving engagement with one of the bevel gears 41 and 43, and a rearward drive position located in axially spaced relation in the other direction from the neutral position and in driving engagement with the other one of the bevel gears 41 and 43.

Means are provided in the propulsion unit for displacing the clutch member or dog 45 between its neutral, forward drive, and rearward drive positions. While various arrangements can be employed, in the construciton illustrated in FIG. 1, such means comprises a shift lever 51 which is movably mounted on the propulsion unit 13 and which is connected by a suitable linkage to the clutch member or dog 45 to cause movement thereof in response to shift lever movement.

Various linkages are known in the art for connecting the shift lever 51 to the clutch member 45. In the illustrated construction, the shift lever 51 is mounted for pivotal movement on a horizontal pivot or axis 53 (See FIG. 2) and the linkage includes a vertically movable member 55 extending lengthwise in the driveshaft housing 23. However, the shift lever 51 could be mounted on a vertical pivot and the vertically extending member could be rotatable about its lengthwise axis to effect shifting of the clutch member or dog 45.

Figure 2:
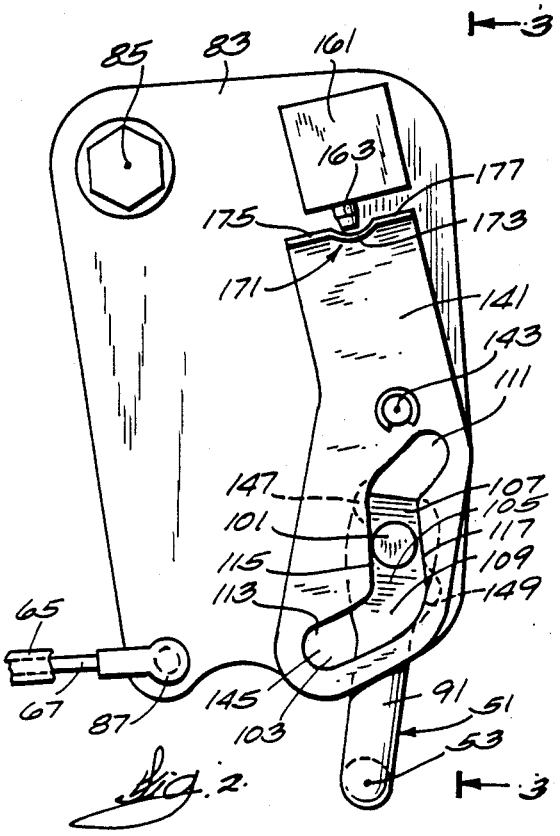
FIG. 2 is an enlarged fragmentary view of various of the components which are shown in FIG. 1 and which are located in a neutral condition.
Figure 3:
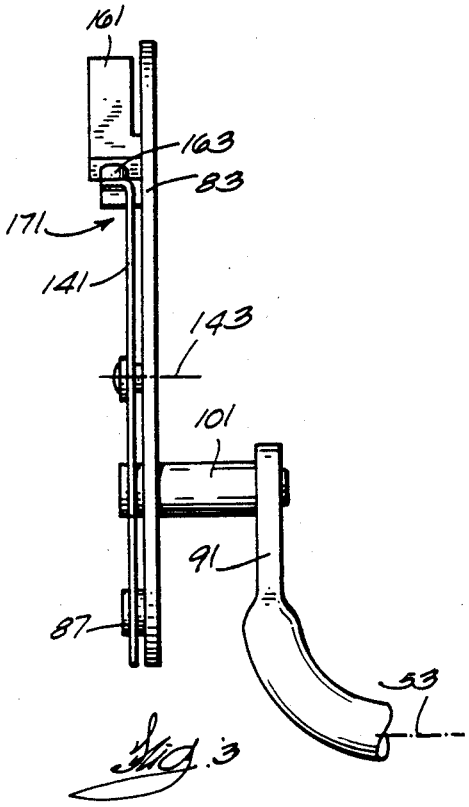
FIG. 3 is an end view taken along line 3—3 of FIG. 2.

In the preferred embodiment remotely located from the marine propulsion device 11 is a single lever control 61 which is adapted to be connected to the marine propulsion device 11 for actuation of the reversing transmission 37 by a push-pull cable 63 including an outer sheath 65 and an inner core or link 67 (See FIG. 2). Any suitable single lever control can be employed. In the disclosed construction, the single lever control 61 includes a control lever 71 which is pivotal about an axis 73, which is actuatable by an operator, and which is connected to the inner core 67. As shown, the control lever 71 is in the neutral position. Movement of the control lever 71 in the counter-clockwise direction from the upright neutral position shown in FIG. 1, displaces the inner core 67 relative to the outer sheath 65 to the right in the drawings and movement of the control 71 lever in the clockwise direction from the neutral position displaces the inner core 67 relative to the outer sheath 65 to the left in the drawings. As thus far disclosed, the construciton is conventional.

The marine propulsion device 11 is also provided with means 81 for connecting the inner core to the shift lever 51 to permit over-travel of the inner core 67 after effecting shifting movement of the shift lever 51 and for temporarily disabling engine ignition at the time of disengagement of the reversing transmission 37.

While other constructions can be employed, in the illustrated construction, the means for permitting over-travel of the inner core 67 after effecting driving engagement of the reversing transmission 37 includes cam and follower means connected to the inner core 67 of the push-pull cable 63 and to the shift lever 51.

More particularly, while other constructions can be employed, the cam and follower means include a shift member or plate 83 which is pivotally mounted on the marine propulsion unit about pivot axis 85 in parallel spaced relation to the pixot axis 53 of the shift lever 51. In addition, the shift member or plate 83 is pivotally connected at a point 87 remote from the axis 85 to the inner core 67 of the push-pull cable 63 so that lengthwise movement of the inner core 67 effects pivotal movement of the shift member or plate 83.

The shift lever 51 is configured to include an arm 91 which extends in spaced parallel relation to the shift member or plate 83 and in transverse relation to the shift lever axis 53.

The shift member or plate 83 and the shift lever arm 91 are provided with a cam slot and follower mechanism so as to afford movement of the shift lever 51 to operate the reversing transmission 37 in response to shift member pivotal movement and to afford over-travel of the shift member of plate 83 relative to the shift lever 51 upon completion of the shifting action of the reversing transmission 37.

The cam slot and follower mechanism comprises a follower 101 which extends from one of the shift lever 51 and the shift member or plate 83 (from the shift lever 51 in the disclosed construction) and which is received in an inclined and closed transmission actuating cam slot 103 which is provided in the other of the shift plate or member 83 and the shift lever 51 (in the shift plate 83 in the disclosed construction). The cam slot 103 includes a central or transmission actuating portion 105 with opposite upper and lower ends 107 and 109, respectively, and upper and lower end, dwell, or over-travel portions 111 and 113 respectively extending from the upper and lower ends 107 and 109 of the central or transmission actuating cam slot portion 105. Still more particularly, the central portion 105 includes opposite side edges 115 and 117 and has a lengthwise center line 121. In order to effect shift lever movement in response to shift member movement, the center line 121 extends at a radius 123 from the shift plate pivot axis 85, which radius 123 increases from the upper cam slot end 107 to the lower cam slot end 109. Accordingly, movement of the shift member or plate 83, when the follower 101 is in the central portion 105 of the cam slot 103, will cause pivotal movement of the shift lever 51 to effect movement of the clutch member between the neutral and the two drive positions.

The cam slot end portion 111 extends from the upper end 107 of the central portion 105 and includes a center line 125 having a constant radius 127 from the pivot axis 85 of the shift member 83. Thus, pivotal movement of the shift member 83, occurring after the follower 101 is located at the upper end 107 of the central portion, serves only to rotate the shift member 83 past the follower 101 and does not cause pivotal movement of the shift lever 51. Accordingly, over-travel of the inner core 67 of the push-pull cable 63 beyond the travel which effects one drive engagement of the reversing transmission is permitted.

The other or lower end portion 113 extends from the other or lower end 109 of the central portion 105 and likewise includes a center line 131 having a constant radius 133 from the shift member pivot axis 85. Thus, pivotal movement of the shift member 83, occurring after the follower 101 is located at the lower end 109 of the cam slot central portion 105, serves only to rotate the shift member 83 past the follower 101 and does not cause pivotal movement of the shift lever 51. Accordingly, as before, over-travel of the inner core 67 of the push-pull cable 63 beyond the travel which effects the other drive engagement of the reversing transmission 37 is permitted.

Figure 4:
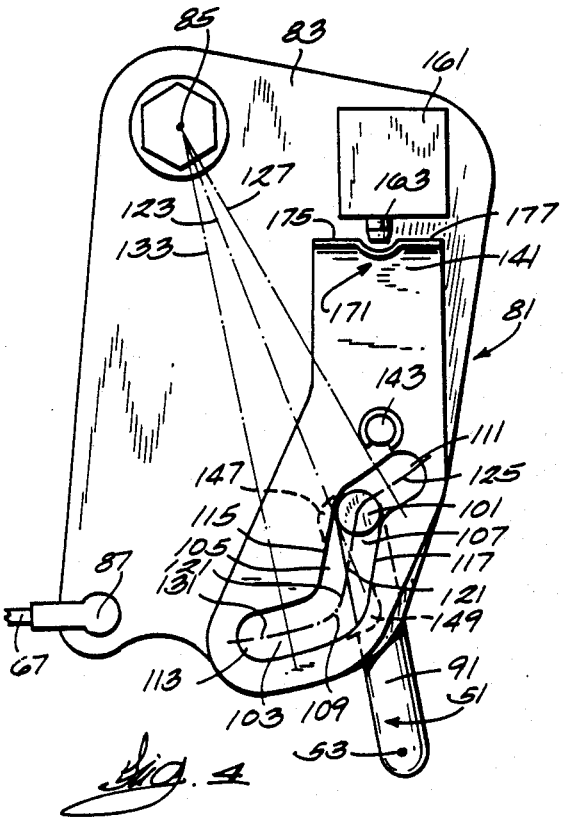
FIG. 4 is a view similar to FIG. 2 showing the components located in one drive condition.

In operation, movement of the cable inner core 67 to the left in the drawings from the neutral position shown in FIG. 2 serves to rotate the shift plate or member 83 in the clockwise direction as shown in FIGS. 2 and 4 through 7. Such movement of the shift member or plate 83 engages the cam slot side edge 117 with the follower 101 and causes the follower 101 to move to the upper end 107 of the cam slot central portion 105 as shown in FIG. 4. Such follower movement causes counter-clockwise rotation of the shift lever 51 to cause the reversing transmission 37 to shift into one drive engagement. Continued movement of the inner core 67 to the left causes additional clockwise movement of the shift plate 83 relative to the follower 101 but does not effect pivoting movement of the shift lever 51. Return movement of the inner core 67 to the right from the drive position shown in FIG. 4 to the neutral position shown in FIG. 2 will engage the cam slot side edge 115 with the follower 101 and cause downward travel of the follower 101 in the cam slot 103 to the central neutral position, thereby causing return of the shift lever 51 in the clockwise direction to the neutral position shown in FIG. 2, and thereby returning the reversing transmission 37 to neutral.

Figure 5:
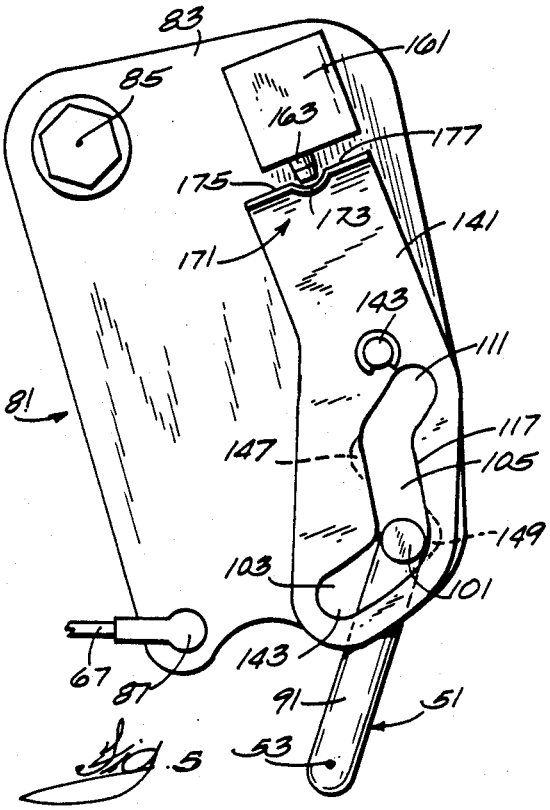
FIG. 5 is a view similar to FIG. 2 showing the components located in another drive condition.
Figure 6:
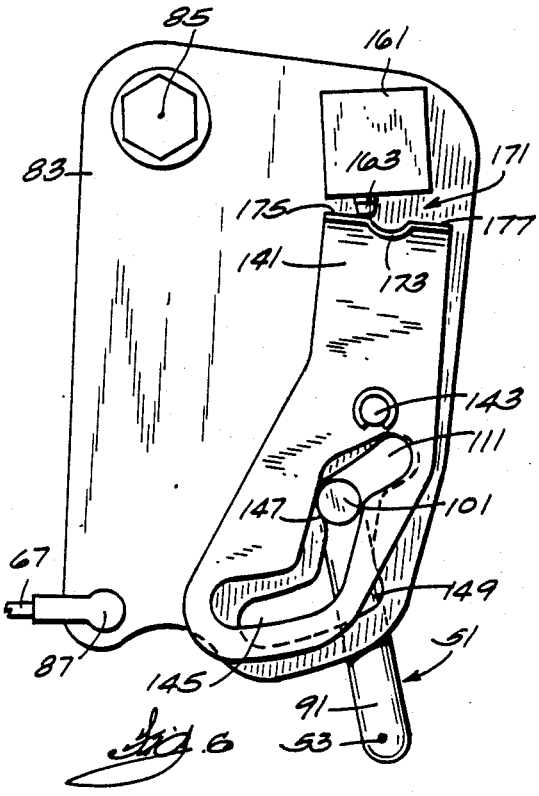
FIG. 6 is a view similar to FIG. 2 illustrating the components during movement out of the one drive condition.
Figure 7:
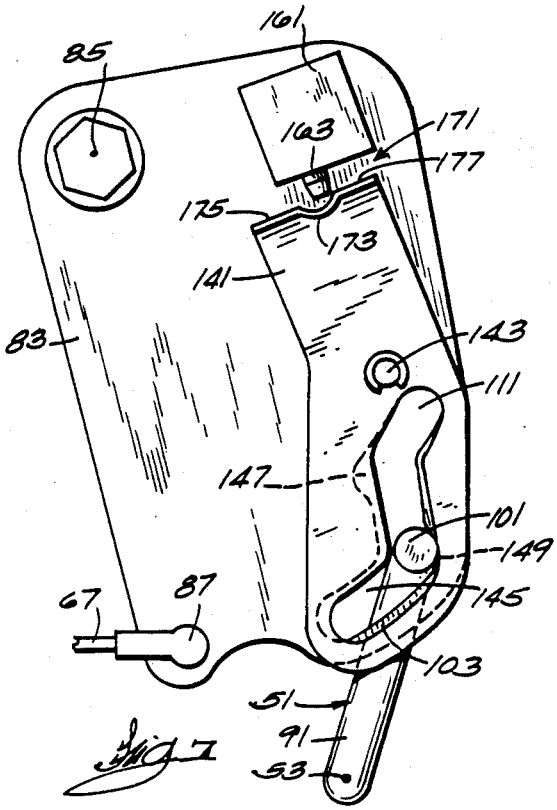
FIG. 7 is a view similar to FIG. 2 illustrating the components during movement out of the other drive condition.

Movement of the cable inner core 67 to the right in the drawings from the neutral position shown in FIG. 2 serves to rotate the shift plate or member 83 in the counter-clockwise direction as shown in FIGS. 2 and 4 through 7. Such movement of the shift plate 83 engages the cam slot side edge 115 with the follower 101 and causes the follower 101 to move downwardly to the lower end 109 of the cam slot central portion 105 as shown in FIG. 5. Such follower movement causes clockwise rotation of the shift lever 51 to cause the reversing transmission 37 to shift into the other drive engagement. Continued movement of the inner core 67 to the right causes further counter-clockwise movement of the shift plate or member 83 but does not cause pivotal movement of the shift lever 51.

Return movement of the inner core 67 to the right from the other drive position shown in FIG. 5 to the neutral position shown in FIG. 2 engages the cam slot edge 117 with the follower 101 and causes upward travel of the follower 101 in the cam slot 103 to the central neutral position causing return of the shift lever 51 in the counter-clockwise direction to the neutral position shown in FIG. 2 and thereby returns the reversing transmission 37 to neutral.

Various means or arrangements can be provided for temporarily interrrupting engine ignition at the time of clutch disengagement. In the disclosed construction, such means comprises a switch plate or member 141 which is mounted on the shift plate or member 83 for relative movement there between. In particular, in the disclosed construction, the switch plate or member 141 is mounted on the shift plate or member 83 for pivotal movement about a pivot axis 85.

Included in the switch plate 141 (See FIG. 6) is a closed shift interrupting cam slot 145 which, except as noted hereinafter, is generally identical to the cam slot 103 in the shift member or plate 83 and which also receives the follower 101. Accordingly, the same numbers used in connection with the cam slot 103 will be used with respect to the cam slot 145. The cam slot 145 in the switch member or plate 141 differs from the cam slot 103 in the shift member or plate 83 by reason of the provision, adjacent the juncture of the central portion 105 and the upper end portion 111, in the cam slot side edge 115, of a recess 147, and the provision, adjacent the junction of the central portion 105 and the lower end portion 113, and in the other cam slot side edge 117, of a second recess 149.

The means for temporarily interrupting engine ignition also includes switch means connected to an ignition system (not shown) and operable, when actuated, to interrupt or prevent engine ignition. Such switch means can take any suitable form and can be operable either upon opening of the ignition circuit or upon closing of the ignition circuit to ground, depending upon the type of ignition circuit employed. In either case, actuation of the switch means, either by opening or closing, serves to interrupt ignition.

While other constructions can be employed, in the disclosed construction, the switch means includes a suitable electrical switch 161 which is connected to the ignition circuit and which includes a plunger 163 which is movable between extended and retracted positions, and which, when depressed into the retracted position, actuates the switch 161. The switch 161 can be mounted on either of the shift plate 83 or the switch plate 141 and, in the disclosed construction, is mounted on the shift plate 83.

The switch means also includes a switch actuator 171 which can be formed on either the shift plate 83 or the switch plate 141 and which, in the disclosed construction, is formed on the switch plate 141. The switch actuator 171 comprises a foot or flange which projects from the switch plate and which provides a profile or surface having a recess 173 which is located between two shoulders 175 and 177 and which receives the plunger 163 in extended condition when the switch plate cam slot 145 is aligned with the shift plate cam slot 103. However, when the switch plate 141 moves (pivots) relative to the shift plate 83, one of the shoulders 175 and 177 serves to depress the plunger 163 to actuate the switch 161 to cause temporary ignition interruption.

In operation, when the shift plate 83 and the switch plate 141 are in alignment, as shown in FIGS. 2, 4, and 5, and when the inner core 67 is displaced to the right to disengage the reversing transmission from the one drive engagement, initial movement of the shift plate 83 in the counter-clockwise direction will cause the follower 101 (See FIG. 6) to pivot the shift lever 51 toward neutral and will also permit entry of the follower 101 into the recess 147, thereby effecting relative pivotal movement between the shift plate 83 and the switch plate 141 and thereby causing the shoulder 175 to depress the plunger 163 to acutate the switch to 161 cause ignition interruption. Continued movement of the shift plate 83 in the counter-clockwise direction causes continued movement of the follower 101 downwardly in the central slot portion 105 from the upper end 107 and toward the neutral position. During such movement, the follower 101 rides out of the recess 147 and into the central portion 105 of the switch plate ignition interrupting cam slot 145, causing re-alignment of the cam slots 145 and 103 in the switch plate 141 and in the shift plate 83, respectively. Such reverse relative movement between the shift plate 83 and the switch plate 141 returns the recess 173 into alignment with the switch plunger 163 and affords extension of the plunger 163 to the extended position, i.e., de-activates the switch 161 so as to permit normal operation of the engine ignition system.

When shifting out of the other drive engagement, and from the position of the components shown in FIG. 5, initial movement of the shift plate 83 in the clockwise direction will cause the follower 101 to displace the shift lever 51 toward neutral and will also permit entry of the follower 101 into the recess 149, thereby effecting relative pivotal movement between the shift plate 83 and the switch plate 141 and thereby causing the shoulder 177 to depress the plunger 163 to actuate the switch 161 to cause ignition interruption. Continued movement of the shift plate 83 in the clockwise direction causes continued movement of the follower 101 upwardly in the central slot portion 105 from the lower end 109 and toward the neutral position. During such movement, the follower 101 rides out of the recess 149 and into the central portion 105 of the switch plate cam slot 145, causing re-alignment of the cam slots 103 and 145 in the shift plate 83 and in the switch plate 141, respectively. Such reverse relative movement between the shift plate 83 and the switch plate 141 returns the recess 173 into alignment with the switch plunger 163 and de-activates the switch 161 so as to permit normal ignition operation.

If desired, the shift lever or member 83 can be provided with a spring mass damper (not shown) to reduce transmission of chattering to the remotely located control lever 71, which chattering can occur in response to clutch member movement.

The over-travel feature disclosed herein beneficially serves to reduce the forces applied to the push-pull cable which actuate the reversing transmission and thereby lessens wear and increases the serviceable life of such actuating cable.

The ignition interruption feature serves to beneficially reduce the loading on the components of the reversing transmission during disengagement thereof and to reduce the effort required to disengage the reversing transmission.

Various of the features of the invention are set forth in the following claims.

We claim:

1. A marine propulsion device comprising a transmission supported on said marine propulsion device and including a clutch member movable between a neutral position and a drive position, a shift lever supported on said marine propulsion device by a pivotal mounting and connected to said clutch member to effect movement of said clutch member in response to movement of said shift lever, and cam and follower means adapted to be connected to a remotely actuated link and connected to said shift lever for displacing said shift lever to effect movement of said clutch member, and for permitting over-travel of the link without displacing said shift lever after shift lever movement effecting movement of said clutch member to said drive position.

2. A marine propulsion device comprising a transmission supported on said marine propulsion device and including a clutch member movable between a neutral position and a drive position, a shift lever supported on said marine propulsion device by a pivotal mounting and connected to said clutch member to effect movement of said clutch member in response to movement of said shift lever, and cam and follower means adapted to be connected to a remotely actuated link and connected to said shift lever for displacing said shift lever to effect movement of said clutch member, and for permitting over-travel of the link without displacing said shift lever after shift lever movement effecting movement of said clutch member to said drive position, said cam and follower means comprising a shift plate movably supported on said marine propulsion device by a pivot mounting and adapted for connection to the remotely actuated link, one of said shift lever and said shift plate having therein a cam slot including a clutch actuating portion having opposite ends, said cam slot being located at a radial distance from the pivotal mounting of said one of said shift lever and said shift plate, said radial distance increasing from one of said ends of said clutch actuating portion to the other of said ends of said clutch actuating portion, said cam slot also including a dwell portion extending from one of said ends of said clutch actuating portion at a uniform radius from the pivotal mounting of said one of said shift lever and said shift plate, and a follower extending from the other of said shift lever and said shift plate and received in said cam slot.

3. A marine propulsion device comprising a transmission supported on said marine propulsion device and including a clutch member movable between a neutral position, a drive position, and another drive position, a shift lever supported on said marine propulsion device by a pivotal mounting and connected to said clutch member to effect movement of said clutch member in response to movement of said shift lever, and cam and follower means adapted to be connected to a remotely actuated link and connected to said shift lever for displacing said shift lever to effect movement of said clutch member, and for permitting over-travel of the link without displacing said shift lever after shift lever movement effecting movement of said clutch member to said drive position, said cam and follower means comprising a shift plate movably supported on said marine propulsion device by a pivot mounting and adapted for connection to the remotely actuated link, one of said shift lever and said shift plate having therein a cam slot including a central portion with a pair of opposite ends, said cam slot being located at a radial distance from the pivotal mounting of said one of said shift lever and said shift plate, said radial distance increasing from one of said ends to the other of said ends, said cam slot also including end portions respectively extending from said ends of said central portion at respectively uniform radii from the pivotal mounting of said one of said shift lever and said shift plate, and a follower extending from the other of said shift lever and said shift plate and received in said cam slot.

4. A marine propulsion device in accordance with claim 3 wherein said cam slot is located in said shift plate and said follower extends from said shift lever.

5. A marine propulsion device comprising a transmission supported on said marine propulsion device and including a clutch member movable between a neutral position and a drive position, a shift lever supported on said marine propulsion device by a pivotal mounting and connected to said clutch member to effect movement of said clutch member in response to movement of said shift lever, and cam and follower means adapted to be connected to a remotely actuated link and connected to said shift lever for displacing said shift lever to effect movement of said clutch member, and for permitting over-travel of the link without displacing said shift lever after shift lever movement effecting movement of said clutch member to said drive position, and for temporarily disabling enging ignition at the time of clutch member movement from said drive position.

6. A marine propulsion device in accordance with claim 5 wherein said cam and follower means comprises a shift plate pivotally unsupported on said marine propulsion device and connected to said clutch member for shift plate movement in coordination with clutch member movement, a switch plate pivotally mounted on said shift plate, one of said shift plate and said switch plate having therein a cam slot, a follower extending from the other of said shift plate and said switch plate and received in said cam slot, a switch mounted on one of said shift plate and said switch plate and adapted to interrupt engine ignition, and an actuator mounted on the other of said shift plate and said switch plate and engagable with said switch for actuation thereof.

7. A marine propulsion device in accordance with claim 5 wherein said cam slot includes a central portion having opposite ends, said cam slot being located at a radial distance from the pivotal mounting of said one of said shift lever and said shift plate, said radial distance increasing from one of said cam slot ends to the other of said cam slot ends, said cam slot also including a dwell portion extending from one of said cam slot ends of said central portion at a uniform radius from the pivotal mounting of said one of said shift lever and said shift plate, said cam slot also including first and second opposed side edges, said first side edge having therein a recess adjacent the juncture of said central portion and said dwell portion.

8. A marine propulsion device in accordance with claim 5 wherein the clutch member is also movable relative to another drive position, and wherein said cam slot includes a central portion with a pair of opposite ends, said cam slot being located at a radial distance from the pivotal mounting of said one of said shift lever and said shift plate, said radial distance increasing from one of said cam slot ends to the other of said cam slot ends, said cam slot also including end portions respectively extending from said cam slot ends of said central portion at respective uniform radii from the pivotal mounting of said one of said shift lever and said shift plate, said cam slot also including first and second opposed side edges, said first side edge having therein a recess adjacent the juncture of said central portion and one of said end portions, and said second side edge having therein a recess adjacent the juncture of said central portion and the other of said end portions.

9. A marine propulsion device in accordance with claim 6 wherein said cam slot is in said switch plate.

10. A marine propulsion deceive in accordance with claim 6 wherein said switch is on said shift plate and said actuator is on said switch plate.

11. A marine propulsion device comprising a transmission supported on said marine propulsion device and including a clutch member movable between a neutral position and two drive positions located respectively on opposite sides of said neutral position, a shift lever pivotally supported on said marine propulsion device and connected to said clutch member to effect movement of said clutch member in response to movement of said shift lever, said shift lever having thereon a follower, a shift plate pivotally supported on said marine propulsion device and adapted for connection to a remotely actuated link to effect pivotal movement of said shift plate in response to movement of the link, said shift plate having therein a transmission actuating cam slot receiving said follower and including a central portion with a pair of opposite ends, said transmission actuating cam slot being located at a radial distance from the pivotal support of said shift plate, said radial distance increasing from one of said ends of said cam slot central portion to the other of said ends of said cam slot central portion, said transmission actuating cam slot also including end portions respectively extending from said ends of said central portion at a uniform radius from the pivotal support of said shift plate, a second plate pivotally mounted on said shift plate and having therein an ignition interrupting cam slot receiving said follower, said ignition interrupting cam slot including a central portion with a pair of opposite ends, and end portions respectively extending from said ends of said central portion, said central portions and said end portions of said transmission actuating cam slot and of said ignition interrupting cam slot being of generally identical size and shape and being located in alignment when said clutch member is in said drive positions, said ignition interrupting cam slot also including first and second opposed side edges, said first side edge having therein a recess adjacent the juncture of said central portion and one of said end portions, and said second side edge having therein a recess adjacent the juncture of said central portion and the other of said end portions, and a switch mounted on one of said shift plate and said second plate and being operable, when actuated, to interrupt engine ignition, and an actuator engagable with said switch for actuation thereof to interrupt engine ignition on the other of said shift plate and said second plate.

12. A linkage adapted for use with a marine propulsion device comprising an engine and a transmission including a clutch member movable between a neutral position and a drive position, said linkage comprising a first member pivotally mounted on a support and movable in coordinated relation to clutch member movement, a second member pivotally mounted on said first member, switch means adapted for interrupting engine ignition, said switch means being mounted on one of said first and second members, an actuator engagable with said switch means for actuation thereof to interrupt engine ignition, said actuator being located on the other of said first and second members and being operable to actuate said switch means to interrupt engine ignition in response to relative displacement between said first and second members, and cam and slot means for actuating said switch at the time of clutch member movement from the drive position, said cam and slot means including a cam slot on one of said first and second members, and a follower extending from the other of said first and second members into said cam slot for displacing said first and second members relative to each other in response to first member pivotal movement.

13. A linkage in accordance with claim 12 wherein said first mentioned cam slot is in said second member and wherein said first member includes a clutch operating cam slot which also receives said follower.

14. A linkage in accordance with claim 13 wherein said cam slot in said first member includes a main portion having a pair of opposite ends, said main portion of said cam slot in said first member being located at a radial distance from the pivotal mounting of said first member, said radial distance increasing from one of said main portion ends to the other of said main portion ends, said cam slot also including a dwell portion extending from one of said main portion ends at a uniform radius from the pivotal mounting of said first member, and wherein said cam slot in said second member comprises a main portion having a pair of opposite ends, and a dwell portion extending from one of said ends of second main portion of said cam slot in said second member, said main portions and said dwell portions of said cam slots in said first and second members being generally of the same size and shape and being in alignment when said clutch member is in said drive position, said cam slot in said second member also including first and second opposed side edges, said first side edge having therein a recess adjacent the juncture of said main portion and said dwell portion.

15. A marine propulsion device comprising a transmission supported on said marine propulsion device and including a clutch member movable between a neutral position and a drive position, a shift lever supported on said marine propulsion device by a pivotal mounting and connected to said clutch member to effect movement of said clutch member in response to movement of said shift lever, and cam slot and follower means adapted to be connected to a remotely actuated link and connected to said shift lever for displacing said shift lever to effect movement of said clutch member, and for permitting over-travel of the link without displacing said shift lever after shift lever movement effecting movement of said clutch member to said drive position.

16. A marine propulsion device comprising a transmission supported on said marine propulsion device and including a clutch member movable between a neutral position and a drive position, a shift lever supported on said marine propulsion device by a pivotal mounting and connected to said clutch member to effect movement of said clutch member in response to movement of said shift lever, a shift member supported on said marine propulsion device by a pivotal mounting and adapted to be connected to a remotely actuated link, and cam and follower means on said shift lever and on said shift plate for displacing said shift lever to effect movement of said clutch member in response to shift plate movement incident to movement of the actuating link, and for permitting over-travel of said link without displacing said shift lever after shift lever movement effecting movement of said clutch member to said drive position.

* * * * *